US005918468A

United States Patent [19]

Cassells et al.

[11] Patent Number: 5,918,468

[45] Date of Patent: Jul. 6, 1999

[54] APPARATUS AND METHOD FOR COOLING OF LIQUIDS

[75] Inventors: John Maclaren Cassells, Huntingdon; Adrian Michael Woodward, Cambridge; Andrew Richard Buchanan Halket, Cambridge; Anne Tregoning Miller, Cambridge, all of United Kingdom

[73] Assignee: TTP Group PLC, Hertfordshire, United Kingdom

[21] Appl. No.: 08/973,934

[22] PCT Filed: Jun. 12, 1996

[86] PCT No.: PCT/GB96/01427

§ 371 Date: Dec. 8, 1997

§ 102(e) Date: Dec. 8, 1997

[87] PCT Pub. No.: WO97/00411

PCT Pub. Date: Jan. 3, 1997

[30] Foreign Application Priority Data

Jun. 16, 1995 [GB] United Kingdom ..... 9512316

[51] Int. Cl.[6] ..... F25D 16/00; F25B 21/02; B67D 1/00; B01F 3/04

[52] U.S. Cl. ..... 62/3.64; 62/393; 222/146.6

[58] Field of Search ..... 62/3.2, 3.3, 3.64, 62/331, 389, 390, 393; 222/146.1, 146.6, 129.1; 261/115, DIG. 7

[56] References Cited

U.S. PATENT DOCUMENTS

| | | | |
|---|---|---|---|
| 3,399,539 | 9/1968 | Herman | 62/3.64 |
| 4,493,441 | 1/1985 | Sedam et al. | 222/129.1 |
| 4,555,371 | 11/1985 | Jeans | 261/122 |
| 5,154,661 | 10/1992 | Higgins | 62/3.3 |
| 5,192,513 | 3/1993 | Stumphauzer et al. | 422/305 |
| 5,544,487 | 8/1996 | Attey et al. | 62/3.7 |
| 5,572,872 | 11/1996 | Hlavacek | 62/3.6 |

FOREIGN PATENT DOCUMENTS

| | | | |
|---|---|---|---|
| 1137281 | 12/1968 | United Kingdom | 62/390 |

*Primary Examiner*—William Doerrler

*Attorney, Agent, or Firm*—Andrus, Sceales, Starke & Sawall

[57] ABSTRACT

A cooling and carbonation apparatus (1) is described which has a cell (2) through which fluid to be cooled and carbonated flows. The cell (2) has first and second sidewalls (9, 15), and an outer wall (13) at least partially enclosing the first sidewall (9) of the cell (2) to form a coolant chamber on a first side of the cell. A cooling device (21), such as a Peltier device, is disposed on one side of the cell (2) in thermal connection with the cell (2), so that heat can be withdrawn from the coolant and the fluid to be cooled in a direction generally across the flow path of the fluid. A body of refrigerated coolant is maintained adjacent to the first sidewall (9) of the cell (2) thereby enhancing the cooling of the fluid. Carbon dioxide can be fed to the cell (2) and the liquid to be cooled pumped out of and back to the cell (2) to improve carbonation.

16 Claims, 3 Drawing Sheets

APPARATUS AND METHOD FOR COOLING OF LIQUIDS

BACKGROUND OF THE INVENTION

The present invention relates to an apparatus and method for cooling a body of liquid.

In recent years there has been an increasing demand by consumers for chilled drinks. However, purchasing cans of drink and storing them in refrigerated conditions is relatively expensive and takes up valuable refrigeration space. At the same time there has been an increase in the buying of carbonated drinks. Expense has resulted in the increased use of carbonation devices for home use, such as the Sodastream® range of products, which allow a user to carbonate a suitable amount of water and then mix it with a concentrate to prepare a carbonated drink. The use of such devices has largely replaced the earlier use of soda water bottles for such purposes.

However, convenient though these are, they are limited to preparation of relatively small amounts of carbonated water manually in batches and are relatively awkward to use as well as store in refrigerated conditions.

There is a need therefore for an apparatus capable of cooling liquid for drinking as it is required and also for an apparatus for carbonating such liquids automatically with a minimum of manual effort by the user.

SUMMARY OF THE INVENTION

According to the present invention there is provided an apparatus for cooling a body of fluid, comprising

- a cell through which fluid to be cooled may flow in use, the cell having first and second sidewalls;
- a wall at least partially enclosing the first sidewall of the cell and forming therewith a coolant chamber on a first side of the cell; and
- a cooling device disposed in thermal connection with the cell, whereby heat can be withdrawn from the coolant and the fluid to be cooled in a direction generally across the flow path of the fluid and a body of refrigerated coolant can be maintained adjacent to the first sidewall of the cell thereby enhancing the cooling of the fluid.

By such apparatus, using water for example as a phase-change coolant, a body of ice may be maintained against the first sidewall of the cell to provide a coolant store avoiding the need to cool the whole body of coolant each time cooled fluid is required to be withdrawn from the apparatus.

The wall may be formed integrally with the cell or may be separate, for example in the form an insulated double walled jacket. Preferably, the cooling device is disposed against the second sidewall of the cell.

The invention also includes a method of cooling a body of fluid using such apparatus.

The apparatus can provided a low cost, low power (eg 70 W) cooling device capable of short term, high power (eg 3500 W) cooling. The cooling capacity will depend on a number of factors, including the size of the coolant reservoir and the phase change coolant.

Preferably, the cell has a plurality of fins extending into the coolant chamber to aid the conduction of heat through the first sidewall. The fins may vary in size, both in width, thickness and length as desired to suit particular applications and fins may, for example, be alternately longer and shorter. The fins may be formed as webs connecting the wall of the coolant chamber and the first sidewall of the cell.

The cooling device preferably comprises a Peltier device secured to a surface of the second sidewall, but it may be disposed elsewhere as long as it is thermally connected to the cell and coolant chamber.

The use of a phase-change coolant allows fluid in the cell to be cooled at a uniform rate and thus to a uniform exit temperature, over a wide range of states of 'charge' of the fluid reservoir. The device may be used for cooling both liquids and gases.

The cooling apparatus may be integral with a carbonating apparatus for carbonating the fluid to be cooled, in which case carbon dioxide is supplied to the apparatus along with the fluid to be carbonated.

The apparatus may be operated in a 'batch' mode whereby the fluid to be cooled is recycled within the apparatus to enhance the speed of cooling.

The apparatus has a wide range of uses other than that mentioned above, including 'instant' chilling for foods etc. (by cooling air passed through the apparatus) and conventional food refrigeration for example.

BRIEF DESCRIPTION OF THE SEVERAL VIEWS OF THE DRAWINGS

One example of an apparatus and method according to the present invention will now be described with reference to the accompanying drawings, in which.

DETAILED DESCRIPTION OF THE INVENTION

Figure 1:
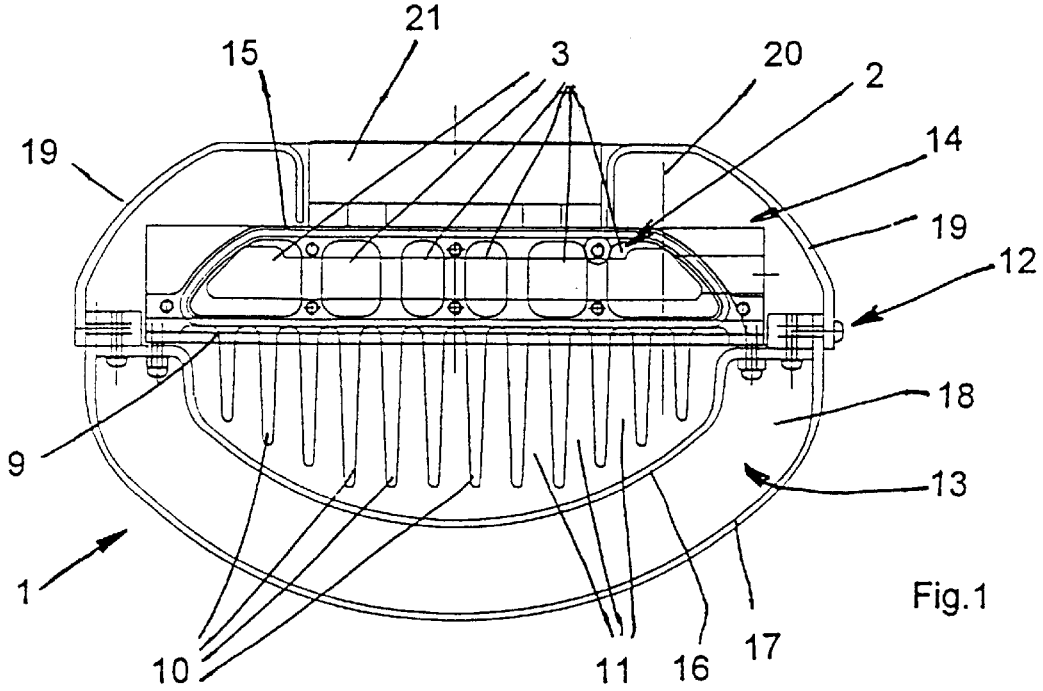
FIG. 1 is a cross-section through the cooling apparatus.
Figure 2:
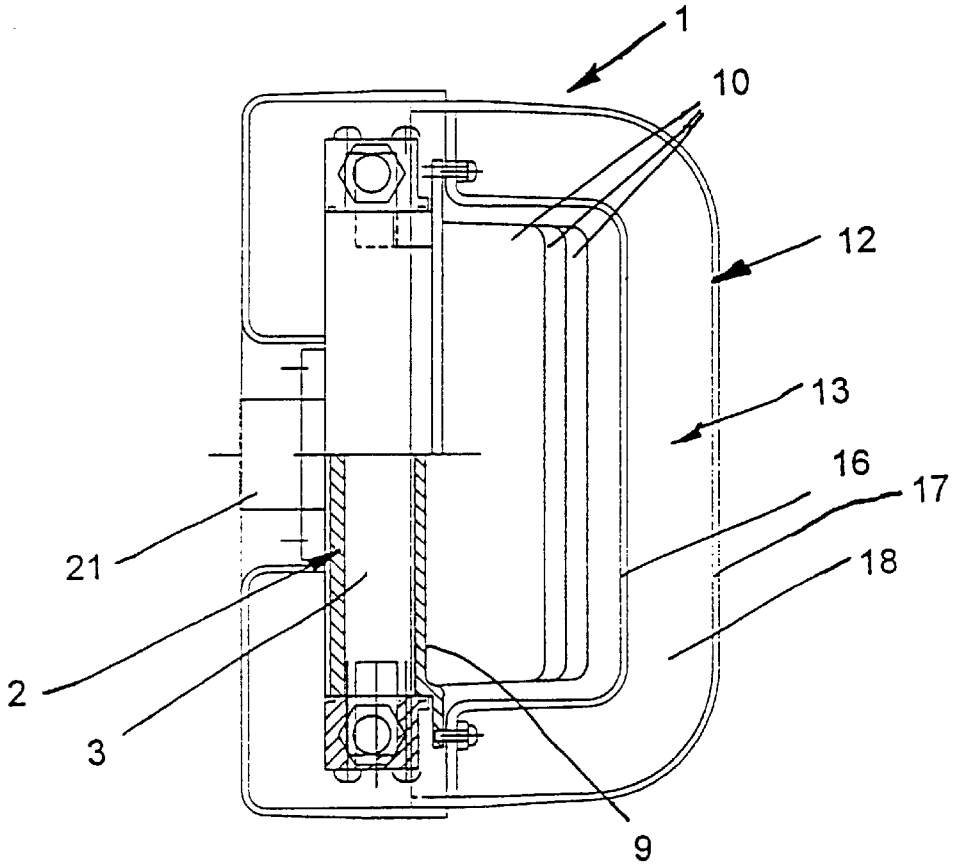
FIG. 2 is a longitudinal part-sectioned view of the apparatus.
Figure 3:
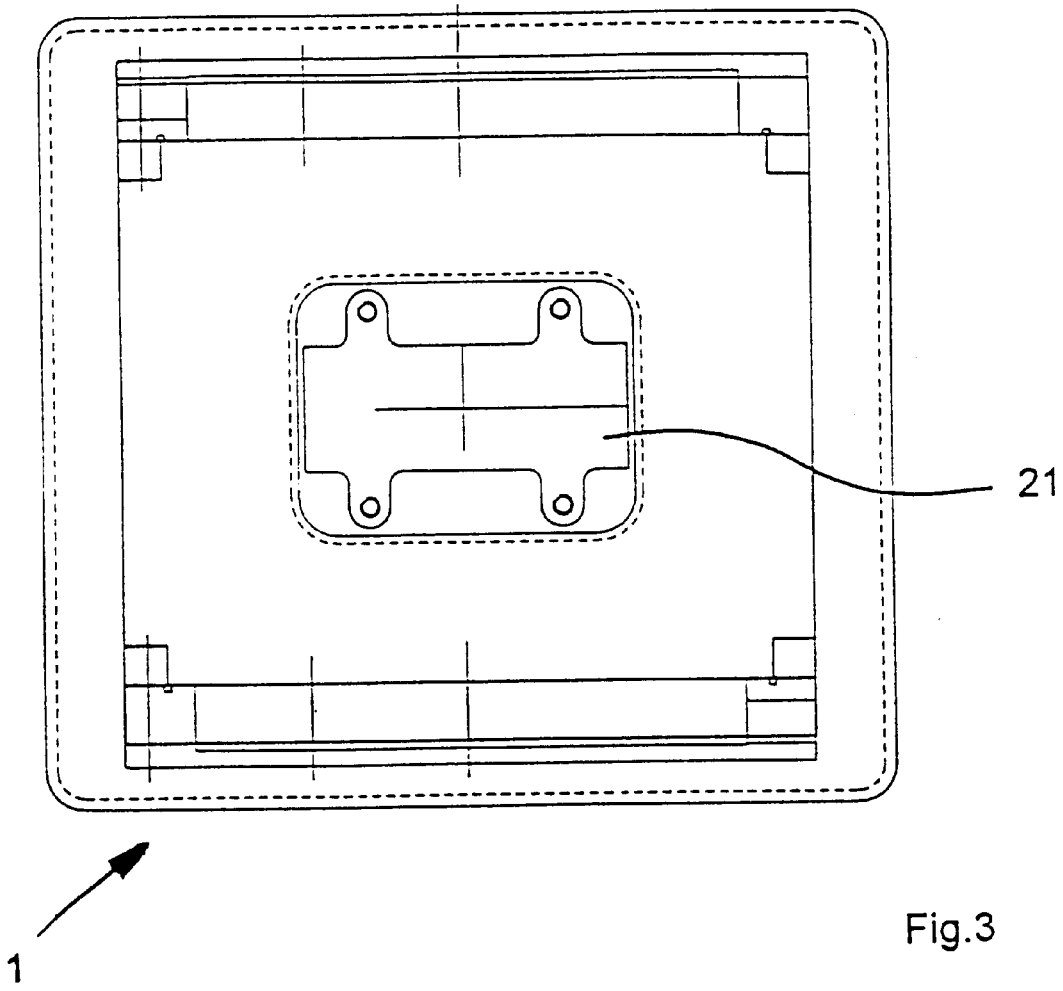
FIG. 3 is a cut-away side view of the apparatus.
Figure 4:
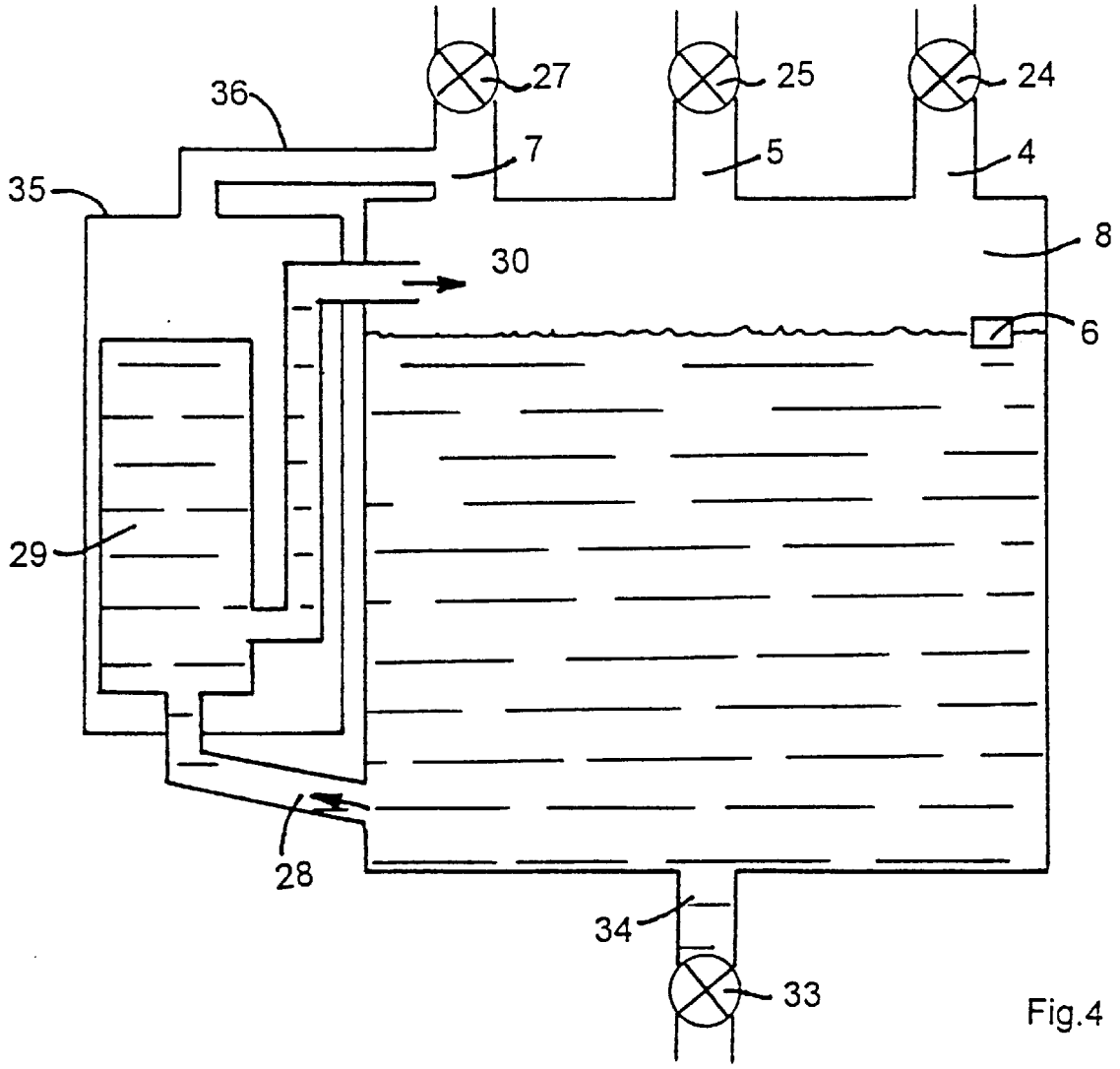
FIG. 4 is a diagrammatic cross-sectional view of the apparatus, showing a connected pump.

The cooling apparatus 1, which, in this example, is integral with a carbonation device for carbonating water, comprises a cell 2 which has a series of passages 3 through which the liquid (water in the present example) flows in use from and to various inlets and outlets as described below. The cell is preferably formed of a metal casting, for example, aluminium, having a high coefficient of thermal conductivity. At the top and bottom of the cell the passages 3 open into header and footer spaces (or manifolds) 8 to which and from which liquid is supplied from and to the cells 3 to and from the outlets and inlets. On one side 9 of the cell 2, a plurality of fins 10 are formed, extending longitudinally of the cell and being spaced apart as shown in FIG. 1 to provide spaces 11 therebetween.

Partially surrounding the cell 2 is a jacket 12 which is formed from a number of components assembled together. The jacket 12 has a first part 13 which overlies the one side 9 of the cell 2 and the ribs 10 and the second part 14 which overlies the other side 15 of the cell 2. The part 13 of the jacket 12 has an inner wall 16 and an outer wall 17, both of which may be formed of a plastics material, with an internal filling 18 of an insulating material such as a polystyrene or polyurethane foam. Alternatively, the jacket may be formed of a rigid insulating material such as a skinned plastics foam, vacuum formed. The other part 14 of the jacket 12 has an outer wall 19 and an internal filling 20 between the wall 19 and the side 15 of the cell 2, again formed of polystyrene or polyurethane foam. The jacket 12, thus forms, with the cell 1, a coolant reservoir. To allow for ice expansion a membrane or compressible material (not shown) is preferably provided in a wall of the reservoir.

Centrally located on the side 15 of the cell 2 there is provided a Peltier device 21 which can be used to extract heat from the cell on one side, radiating it away on the other side. Plural Peltier devices may be used if desired.

In use, a body of coolant, for example water, is contained between the side 9 of the cell 2 and inner skin 16 of the jacket part 13 and is frozen by operation of the Peltier device 21 to provide a 'store' of ice to provide primary cooling of water introduced into and dispensed from the cell 1.

Water to be cooled and carbonated is introduced through an inlet 4 from the mains supply or via a pump (not shown), via a valve 24. While water is being introduced, a vent 5 is opened by a valve 25 to allow air in the cell to be displaced. The associated control system (not shown) closes the water inlet valve 24 when the water reaches an appropriate level sensed by a sensor 6, such as a conductivity sensor, and the vent 5 is closed.

To provide for carbonation of the water, $CO_2$ is then introduced to the cell 1 through an inlet 7 via a valve 27 from a conventional pressurised container (not shown). Water introduced into the cell is pumped from an outlet 28 by a pump 29 and back into the top of the cell, in a spray, though inlet 30 into the head space or manifold area 8. The violent agitation and break-up of the spray into droplets improves carbonation and the water recirculation ensures complete carbonation as well as efficient heat transfer for cooling.

At the end of the carbonation cycle, the $CO_2$ valve 27 is closed and the pump 29 switched off. After an interval to allow the water flow to stop, the vent valve 25 is opened to allow $CO_2$ to be vented gradually to avoid degassing. A dispensing valve 33 is opened to allow carbonated/cooled water to flow out through the outlet 34. The vent valve 25 is a differential type valve which allows air to flow into the cell 1 more freely than it allows $CO_2$ to flow out, thus preventing any appreciable negative pressure within the cell during dispensing and reducing degassing.

The pump 29 is contained in a pressurised vessel 35 connected to the cell 1 by a pipe 36 and is thus filled with $CO_2$ at the same time as the cell. An alternative construction would be to locate the pump in the header space 8. These constructions avoid the need for shaft seals which would otherwise be required on the pump to take the full carbonation pressure in use.

The differential valve 25 may consist of two one-way valves with adjustable restrictions, connected by a common manifold to the vent passage 5.

We claim:

1. An apparatus for cooling a body of fluid, said apparatus comprising:

a cell (2) through which fluid to be cooled may, in use, flow, said cell having a first sidewall (9), a second, opposite sidewall (15) spaced from said first sidewall, an inlet (30) and outlet (28) disposed at opposite ends of the cell to define a flow path for the fluid between the sidewalls in a direction from one end of the cell to the other end of the cell;

a coolant chamber adjacent said cell, said coolant chamber being partially defined by an outer wall (13) at least partially enclosing said first sidewall of said cell, said coolant chamber containing a body of coolant; and a cooling device (21) disposed on said second sidewall of said cell, said cooling device withdrawing heat from the fluid in said cell and said body of coolant in said coolant chamber across the flow path of the fluid in the cell to maintain a body of refrigerated coolant in said coolant chamber adjacent said first sidewall of said cell to enhance the cooling of the fluid in said cell.

2. Apparatus according to claim 1 wherein said outer wall is formed integrally with said first sidewall of said cell.

3. Apparatus according to claim 1 wherein said outer wall is formed as a discrete component with respect to said first sidewall of said cell.

4. Apparatus according to claim 3, wherein the outer wall comprises an insulated double walled jacket.

5. Apparatus according to claim 3 wherein the outer wall comprises an insulated double walled jacket.

6. Apparatus according to claim 1, wherein the cell has a plurality of fins extending into the coolant chamber to aid the conduction of heat through the first sidewall.

7. Apparatus according to claim 6, wherein the fins vary in size.

8. Apparatus according to claim 6, wherein the fins are formed as webs connecting the outer wall of the coolant chamber and the first sidewall of the cell.

9. Apparatus according to claim 1, wherein the cooling device comprises a Peltier device.

10. Apparatus according to claim 1, further including a phase-change coolant.

11. Apparatus according to claim 9 further including a phase-change coolant.

12. Apparatus according to claim 1 further including means for supplying carbon dioxide to the fluid.

13. A method for cooling a liquid comprising the steps of:

passing the liquid along a flow path through a cell (2) from one end to the other, the cell having spaced sidewalls (9,15) with the flow path extending therebetween;

providing a coolant in a coolant chamber formed between an outer wall (13) at least partially enclosing the first sidewall (9) of the cell and the first sidewall;

withdrawing heat from the cell (2) by means of a cooling device (21) disposed in thermal connection with the second side wall (15) of the cell to withdraw heat from the liquid in the cell and the coolant in the coolant chamber in a direction generally across the flow path of the liquid; and maintaining a body of refrigerated coolant adjacent to the first sidewall (9) of the cell with the coolant chamber thereby enhancing the cooling of the liquid.

14. A method according to claim 13, whereby the fluid to be cooled is recycled within the apparatus to enhance the speed of cooling.

15. A method according to claim 13 further including the step of supplying carbon dioxide to the liquid within the cell to carbonate the liquid.

16. A method according to claim 13, further comprising the steps of:

supplying carbon dioxide to the cell (2) and maintaining a pressurized header (8) of carbon dioxide in the cell; and withdrawing liquid from a bottom of the cell and passing it back to the cell in a spray directed into the header (8).

* * * * *